US012065286B1

(12) United States Patent
Robbins et al.

(10) Patent No.: US 12,065,286 B1
(45) **Date of Patent: *Aug. 20, 2024**

(54) COOLER ASSEMBLY WITH TURRETED ARTICLE-STORAGE LEGS

(71) Applicant: Goat Outdoor, Inc., Houston, TX (US)

(72) Inventors: Jack W. Robbins, Houston, TX (US); Sean Beaudette, Pittsburgh, PA (US)

(73) Assignee: Goat Outdoor, Inc., Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/200,292

(22) Filed: May 22, 2023

Related U.S. Application Data

(63) Continuation of application No. 17/216,799, filed on Mar. 30, 2021, now abandoned, which is a continuation of application No. 16/295,661, filed on Mar. 7, 2019, now Pat. No. 10,961,020.

(51) Int. Cl.

| | |
|---|---|
| ***B65D 25/24*** | (2006.01) |
| ***B65D 25/08*** | (2006.01) |
| ***B65D 25/42*** | (2006.01) |
| ***B65D 43/16*** | (2006.01) |
| ***B65D 51/24*** | (2006.01) |
| ***B65D 81/38*** | (2006.01) |

(52) U.S. Cl.
CPC ..... *B65D 25/24* (2013.01); *B65D 25/08* (2013.01); *B65D 25/42* (2013.01); *B65D 43/163* (2013.01); *B65D 51/242* (2013.01); *B65D 81/3816* (2013.01)

(58) Field of Classification Search
CPC .... A45C 11/20; A01K 97/10; B65D 81/3205; B65D 25/24; F25D 3/08
USPC ..... 220/23.2, 23.8
See application file for complete search history.

(56) References Cited

U.S. PATENT DOCUMENTS

| | | | |
|---|---|---|---|
| 5,329,787 | A | 7/1994 | Friday |
| 5,480,170 | A | 1/1996 | Kaiser |
| 6,796,319 | B1 | 9/2004 | Patarra |
| D511,457 | S | 11/2005 | Biesecker |
| 7,156,226 | B1 | 1/2007 | Van Sickle |
| 7,284,763 | B1 | 10/2007 | King |
| 8,863,546 | B2 | 10/2014 | Oberweis |
| 9,282,797 | B1 | 3/2016 | Soto |
| 9,297,568 | B1 | 3/2016 | Thompson |
| 2004/0154953 | A1 | 8/2004 | Ravikumar |
| 2005/0263527 | A1 | 12/2005 | Maldonado |
| 2007/0108248 | A1 | 5/2007 | Hoffmeier |
| 2008/0217340 | A1 | 9/2008 | Jager |
| 2012/0138605 | A1 | 6/2012 | Grundy |
| 2015/0238033 | A1 | 8/2015 | Zavitsanos |
| 2019/0000205 | A1 | 1/2019 | Carden |
| 2019/0059347 | A1 | 2/2019 | McPherson |

*Primary Examiner* — Jeffrey R Allen
(74) *Attorney, Agent, or Firm* — Schwartz Law Firm, P.C.; Jeffrey J. Schwartz

(57) ABSTRACT

A cooler assembly includes a cooler body and a plurality of turreted article-storage legs. The cooler body has integrally formed insulated side walls and an insulated bottom. The side walls and bottom cooperate to define an insulated interior compartment of the cooler assembly. The turreted article-storage legs are located adjacent the side walls of the cooler body and reside outside of the interior compartment. Each turreted article-storage leg has a hollow interior and an open top for receiving an article to be stored within the hollow interior.

14 Claims, 12 Drawing Sheets

COOLER ASSEMBLY WITH TURRETED ARTICLE-STORAGE LEGS

TECHNICAL FIELD AND BACKGROUND OF THE DISCLOSURE

The present disclosure relates broadly and generally to a cooler assembly with turreted article-storage legs.

SUMMARY OF EXEMPLARY EMBODIMENTS

Various exemplary embodiments of the present disclosure are described below. Use of the term "exemplary" means illustrative or by way of example only, and any reference herein to "the invention" is not intended to restrict or limit the invention to exact features or steps of any one or more of the exemplary embodiments disclosed in the present specification. References to "exemplary embodiment," "one embodiment," "an embodiment," "various embodiments," and the like, may indicate that the embodiment(s) of the invention so described may include a particular feature, structure, or characteristic, but not every embodiment necessarily includes the particular feature, structure, or characteristic. Further, repeated use of the phrase "in one embodiment," or "in an exemplary embodiment," do not necessarily refer to the same embodiment, although they may.

It is also noted that terms like "preferably", "commonly", and "typically" are not utilized herein to limit the scope of the claimed invention or to imply that certain features are critical, essential, or even important to the structure or function of the claimed invention. Rather, these terms are merely intended to highlight alternative or additional features that may or may not be utilized in a particular embodiment of the present invention.

According to one exemplary embodiment, the present disclosure comprises a cooler assembly including a cooler body and a plurality of turreted article-storage legs. The cooler body has integrally formed insulated side walls and an insulated bottom. The side walls and bottom cooperate to define an insulated interior compartment of the cooler assembly. The turreted article-storage legs are located adjacent the side walls of the cooler body and reside outside of the interior compartment. Each turreted article-storage leg has a hollow (and slightly tapered) interior and an open top for receiving an article to be stored within the hollow interior. The hollow interior extends substantially the entire vertical length of the turret leg.

The term "turreted" refers broadly herein to a structure having a generally turret-like appearance, including generally circular, frustoconical, rectangular and other multi-sided structures.

The term "article" refers broadly herein to any solid, liquid or gaseous product.

According to another exemplary embodiment, the cooler body has an open top, and a pivoted insulated cooler lid adapted for selectively closing the open top.

According to another exemplary embodiment, the pivoted cooler lid when closed is configured to cover only the open top of the cooler body, such that the open top of each turreted article-storage leg remains uncovered by the cooler lid and otherwise accessible.

According to another exemplary embodiment, the cooler body has a substantially rectangular form.

According to another exemplary embodiment, the turreted article-storage legs are symmetrically-arranged at respective corners of the cooler body.

According to another exemplary embodiment, the open tops of respective turreted article-storage legs angle downwardly from the open top of the cooler body.

According to another exemplary embodiment, each turreted article-storage leg extends substantially from the open top of the cooler body downward beyond the bottom of the cooler body, such that bottom ends of the article-storage legs locate the cooler bottom above the ground (or other support surface).

According to another exemplary embodiment, the plurality of turreted article-storage legs are integrally formed with the cooler body, such that the article-storage legs and the cooler body comprise a seamless homogenous exterior side of said cooler assembly.

According to another exemplary embodiment, a portable canister is configured to removably fit within the hollow interior of the turreted article-storage leg.

According to another exemplary embodiment, the canister comprises a pivoted canister lid.

According to another exemplary embodiment, the canister lid comprises a handle.

According to another exemplary embodiment, a dry storage basket is removably positioned within the insulated interior compartment of the cooler assembly.

According to another exemplary embodiment, a compartment divider is removably positioned within the insulated interior compartment of the cooler assembly.

According to another exemplary embodiment, each of the side walls and bottom of the cooler body comprises a polyurethane foam insulation.

According to another exemplary embodiment, the cooler body is further constructed of a low-density polyethylene (LDPE) material.

According to another exemplary embodiment, the cooler body further comprises a removable drain plug.

According to another exemplary embodiment, a cargo net is attached to an exterior of one of the side walls of the cooler body.

According to another exemplary embodiment, first and second flexible tote handles are attached to opposing side walls of the cooler body.

According to another exemplary embodiment, first and second integrally-formed lip handles are located on respective opposing side walls of the cooler body.

According to another exemplary embodiment, a plurality of horseshoe-shaped rubber feet are located beneath respective turreted article-storage legs.

BRIEF DESCRIPTION OF THE DRAWINGS

Exemplary embodiments of the present disclosure will hereinafter be described in conjunction with the following drawing figures, wherein like numerals denote like elements, and wherein.

DESCRIPTION OF EXEMPLARY EMBODIMENTS AND BEST MODE

The present invention is described more fully hereinafter with reference to the accompanying drawings, in which one or more exemplary embodiments of the invention are shown. Like numbers used herein refer to like elements throughout. This invention may, however, be embodied in many different forms and should not be construed as limited to the embodiments set forth herein; rather, these embodiments are provided so that this disclosure will be operative, enabling, and complete. Accordingly, the particular arrangements disclosed are meant to be illustrative only and not limiting as to the scope of the invention, which is to be given the full breadth of the appended claims and any and all equivalents thereof. Moreover, many embodiments, such as adaptations, variations, modifications, and equivalent arrangements, will be implicitly disclosed by the embodiments described herein and fall within the scope of the present invention.

Although specific terms are employed herein, they are used in a generic and descriptive sense only and not for purposes of limitation. Unless otherwise expressly defined herein, such terms are intended to be given their broad ordinary and customary meaning not inconsistent with that applicable in the relevant industry and without restriction to any specific embodiment hereinafter described. As used herein, the article "a" is intended to include one or more items. Where only one item is intended, the term "one", "single", or similar language is used. When used herein to join a list of items, the term "or" denotes at least one of the items, but does not exclude a plurality of items of the list.

For exemplary methods or processes of the invention, the sequence and/or arrangement of steps described herein are illustrative and not restrictive. Accordingly, it should be understood that, although steps of various processes or methods may be shown and described as being in a sequence or temporal arrangement, the steps of any such processes or methods are not limited to being carried out in any particular sequence or arrangement, absent an indication otherwise. Indeed, the steps in such processes or methods generally may be carried out in various different sequences and arrangements while still falling within the scope of the present invention.

Additionally, any references to advantages, benefits, unexpected results, or operability of the present invention are not intended as an affirmation that the invention has been previously reduced to practice or that any testing has been performed. Likewise, unless stated otherwise, use of verbs in the past tense (present perfect or preterit) is not intended to indicate or imply that the invention has been previously reduced to practice or that any testing has been performed.

Figure 1:
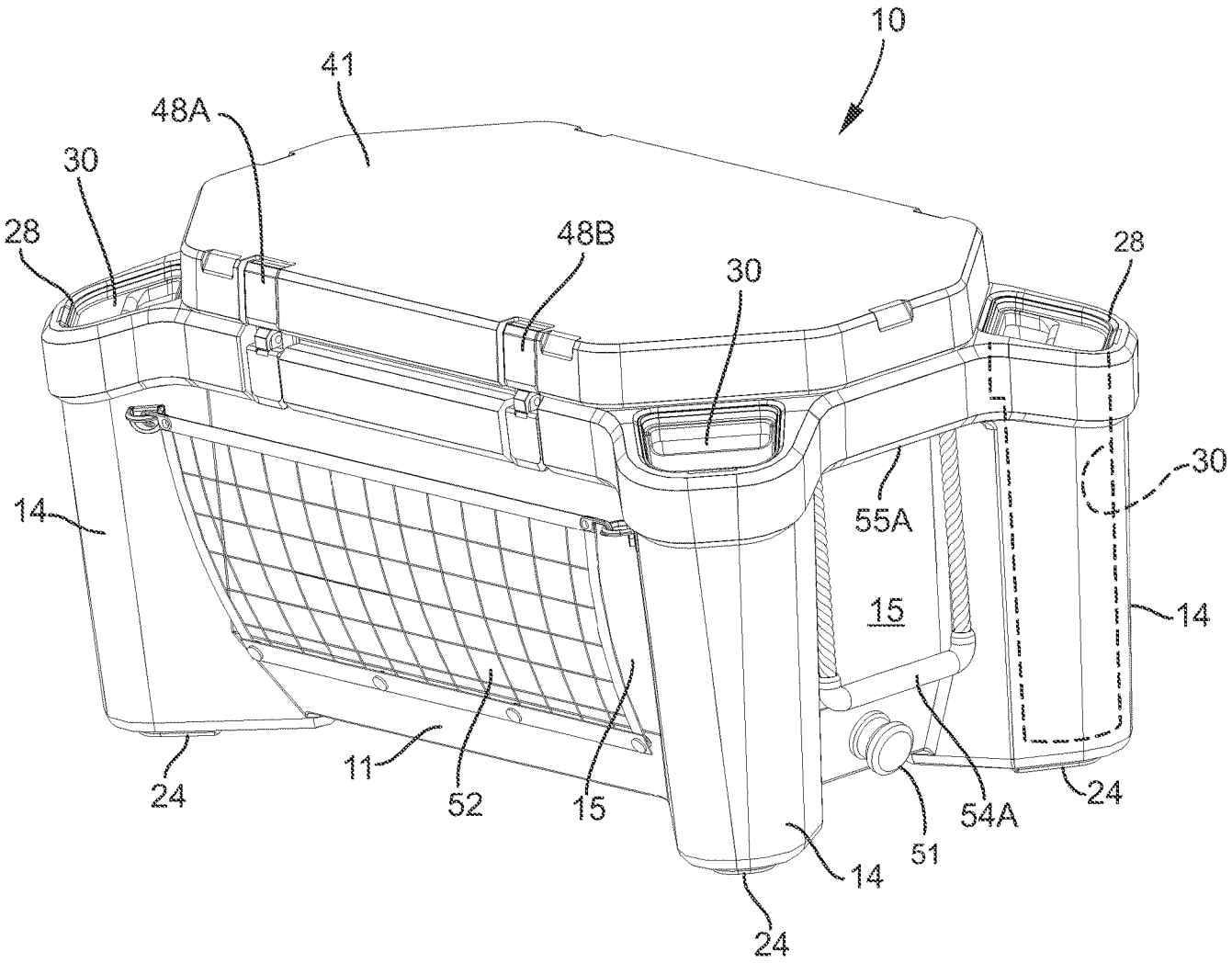
FIG. 1 is a front perspective view of the present cooler assembly according to one exemplary embodiment of the present disclosure.
Figure 2:
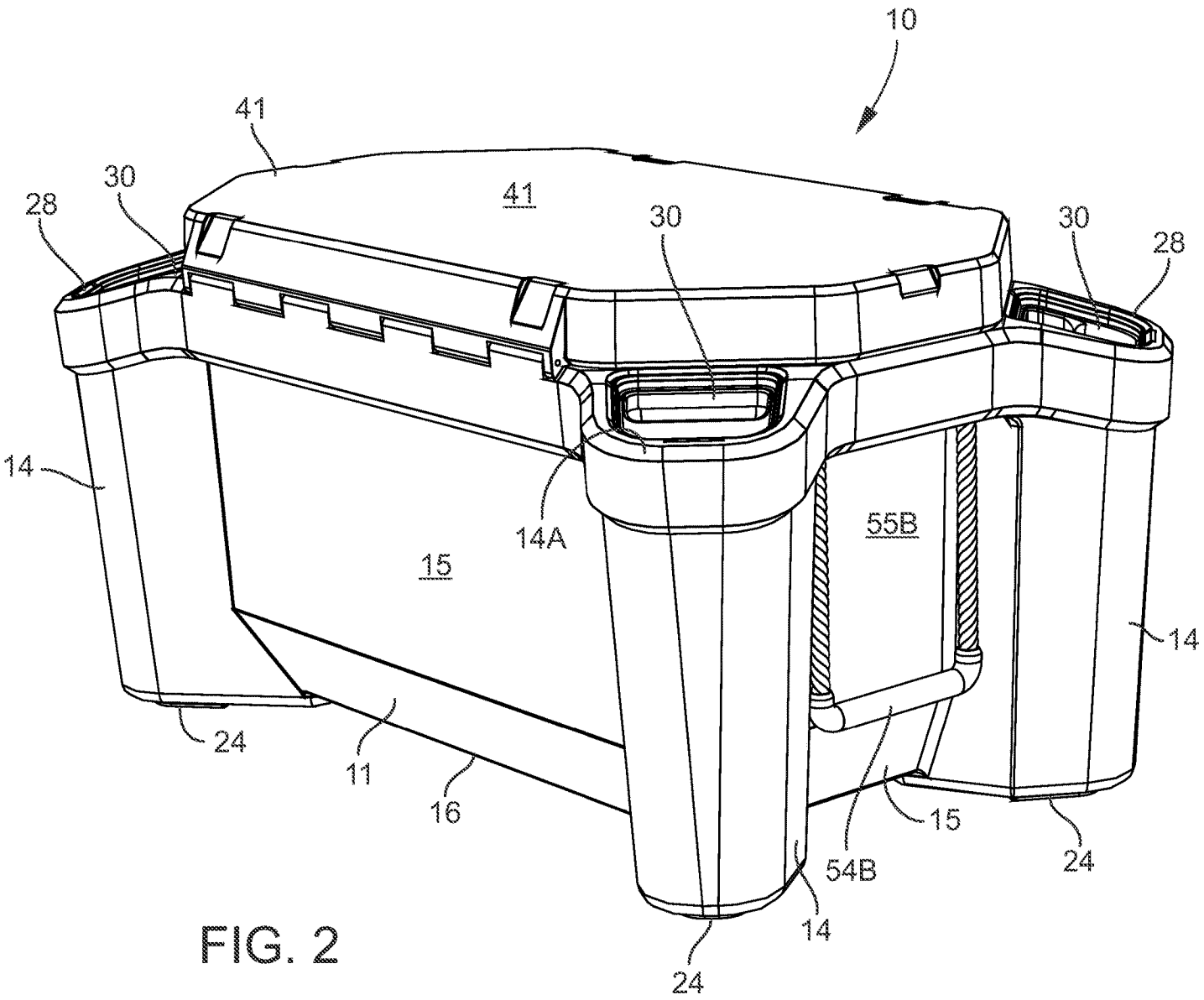
FIG. 2 is a rear perspective view of the exemplary cooler assembly.
Figure 3:
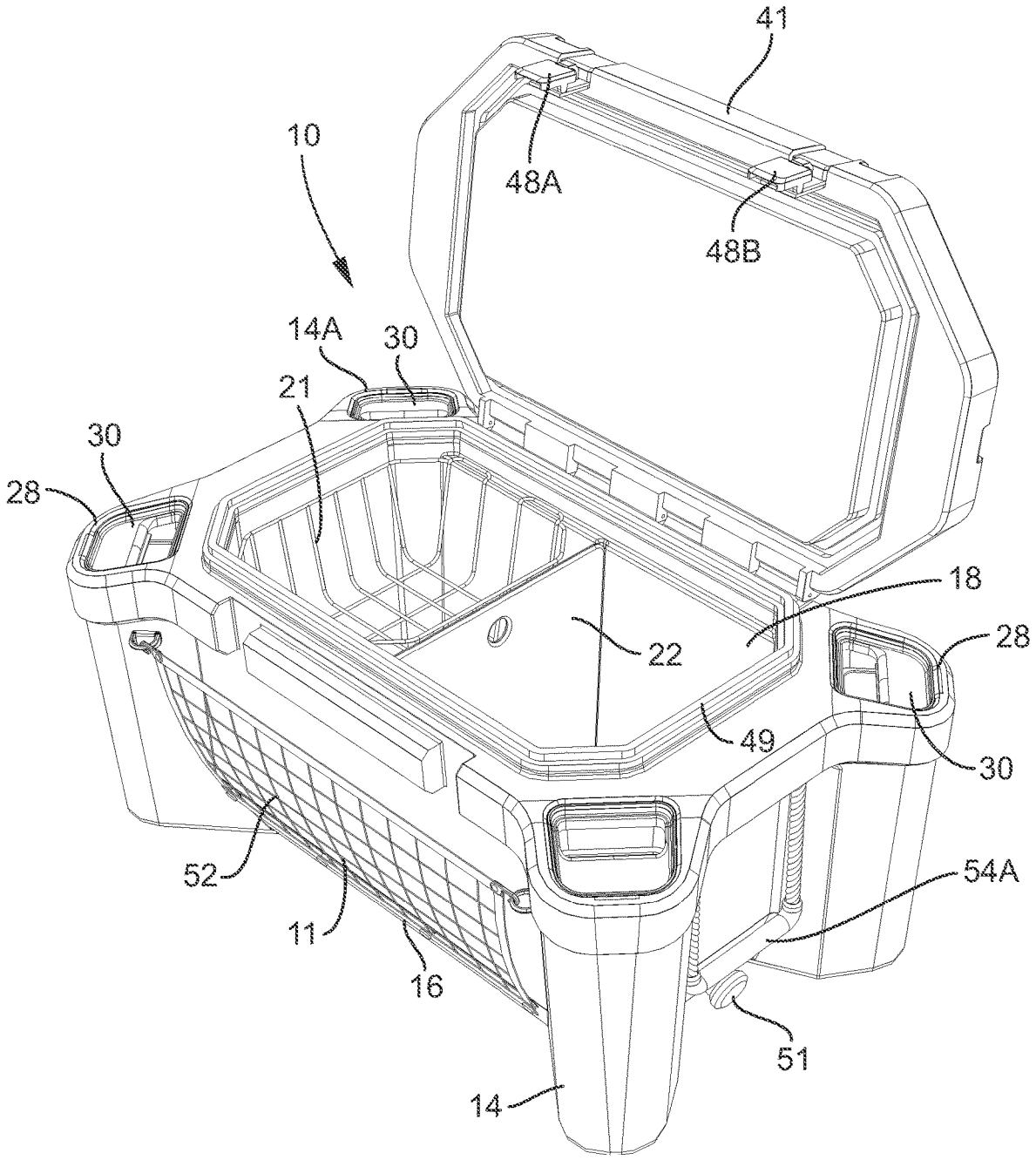
FIG. 3 is a further front perspective view of the exemplary cooler assembly with the cooler lid pivoted to an open position.

Referring now specifically to the drawings, a cooler assembly according to one exemplary embodiment of the present disclosure is illustrated in FIGS. 1, 2, and 3, and shown generally at broad reference numeral 10. The exemplary cooler assembly 10 comprises a substantially rectangular cooler body 11 having an open top 12 (FIG. 3) and identical turreted article-storage legs 14. The cooler body 11 is constructed of a molded plastic, such as linear low-density polyethylene (LLDPE), and has integrally-formed insulated side walls 15 and a bottom 16. The side walls 15 and bottom 16 comprise 1-2 inches (thickness) of pressure-injected commercial-grade polyurethane foam insulation, and cooperate to define a seamless leakproof interior compartment 18 of the assembly 10. See FIG. 3. The interior compartment 18 may include any number of common cooler accessories, such as a removable wire-grid basket 21 for dry storage items and a vertically-disposed removable divider 22. The removable divider 22 may also serve as a cutting board.

Figure 4:
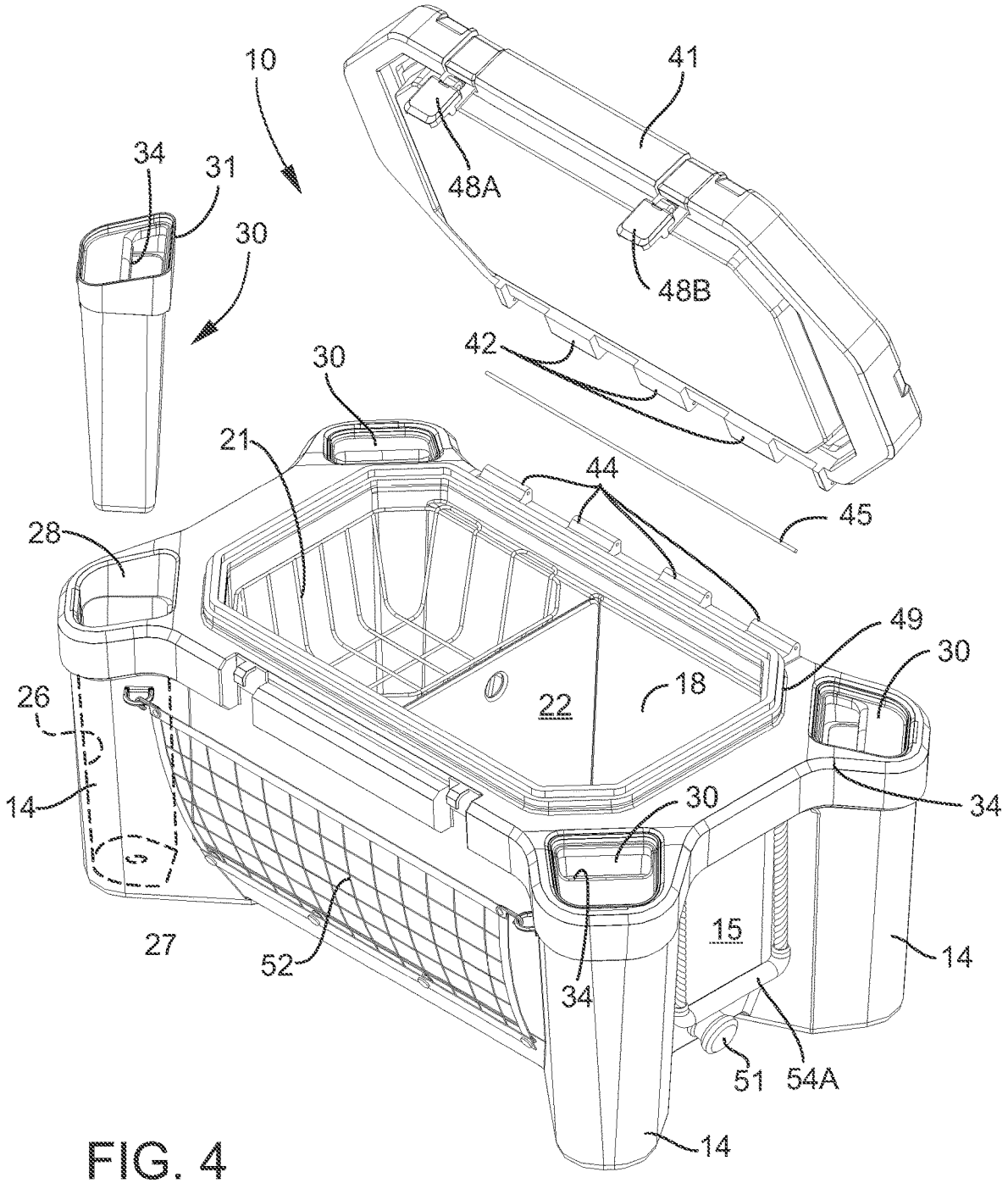
FIG. 4 is a further front perspective view of the exemplary cooler assembly with various parts exploded away.
Figure 5:
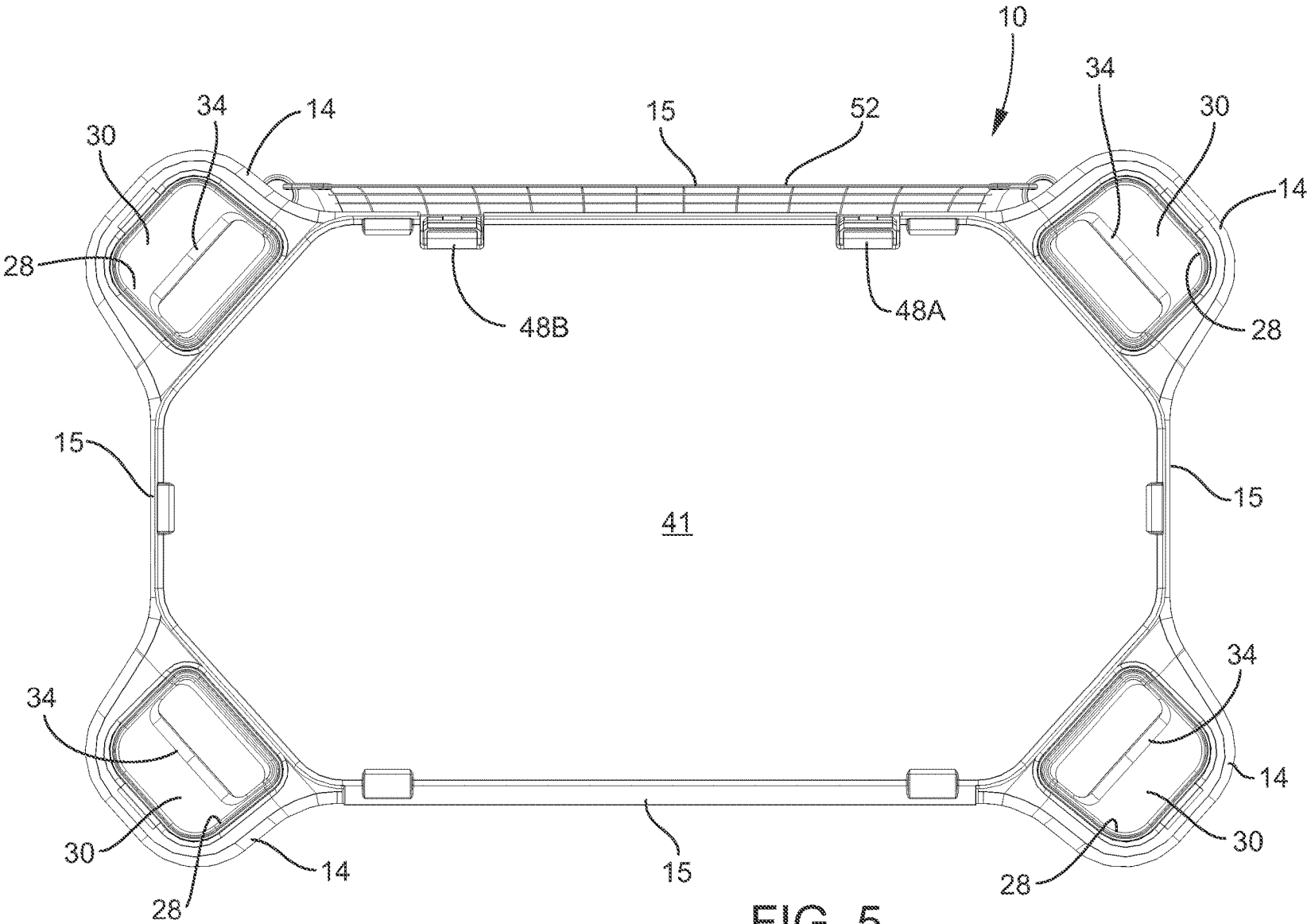
FIG. 5 is a top plan view of the exemplary cooler assembly with the pivoted lid in the closed position.
Figure 6:
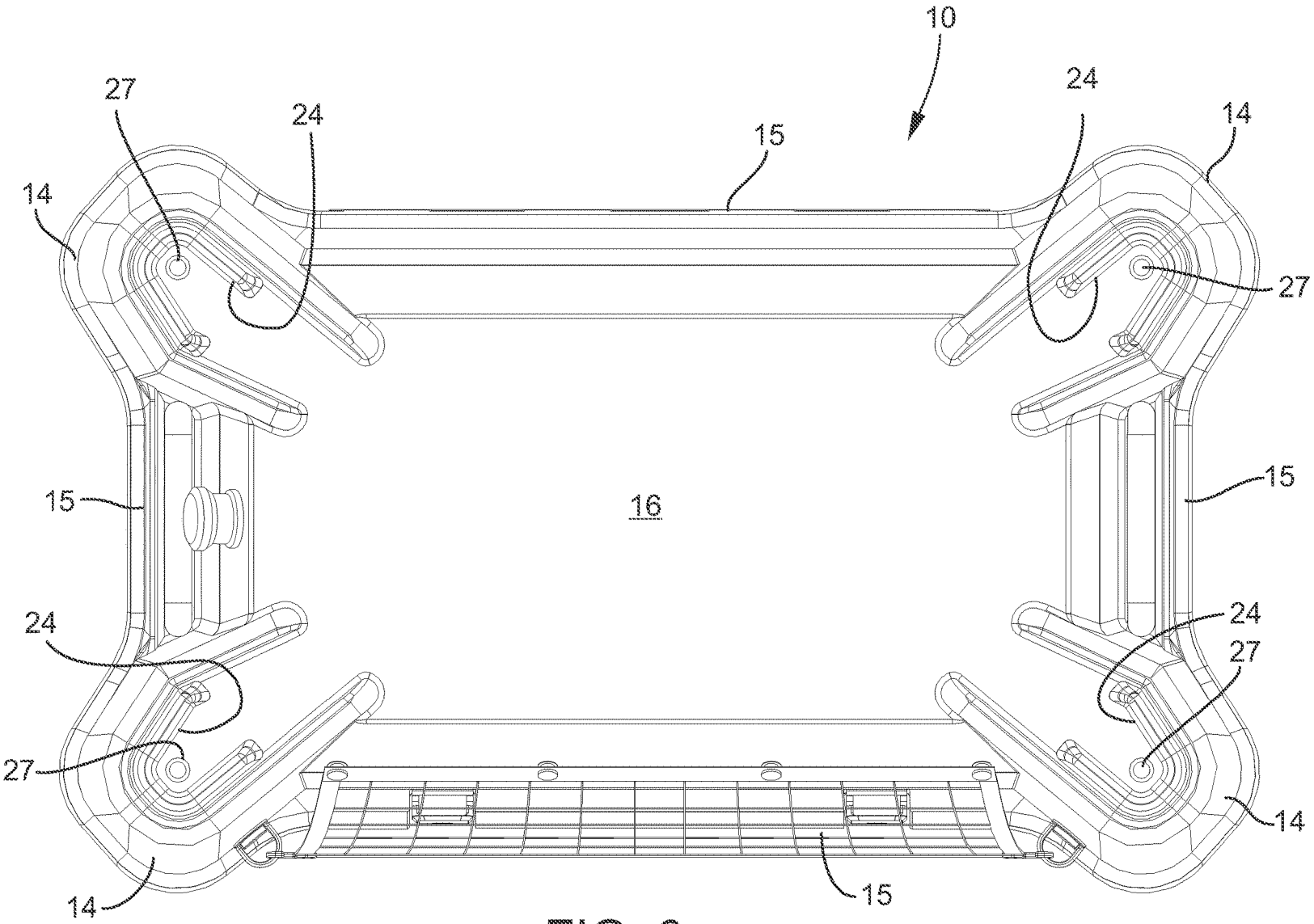
FIG. 6 is a bottom plan view of the exemplary cooler assembly.

As best shown in FIGS. 4, 5 and 6, the turreted article-storage legs 14 are symmetrically-arranged at respective corners of the cooler body 11 and extend substantially from the open top 12 downward beyond the cooler bottom 16. The turreted legs 14 cooperate to support and stabilize the cooler assembly 10 on the ground (or other underlying surface), and comprise horseshoe-shaped rubber feet 24 which offer slip-resistance and further elevate the cooler bottom 16 above the ground. Each turreted leg 14 has a slightly tapered hollow interior 26, a bottom drain hole 27, and an open top 28 directly adjacent the cooler top 12. The open top 28 of each turreted leg 14 is formed at a slight downward angle from the cooler top 12, and is designed to closely receive a removable complementary-tapered canister 30 into the hollow interior of the turreted leg 14. In the present embodiment, the canister 30 is of a size and shape sufficient to be entirely stored safely within the turreted leg 14. The cooler body 11 and turreted legs 14 may be integrally-molded together as a single, substantially seamless homogenous unit. The integral walls forming the turreted legs 14 may be fully insulated using 1-2 inches of polyurethane foam, lightly insulated or non-insulated—comprising only a single thickness of LLDPE or other such material. Alternatively, all or a portion of one or more turreted legs 14 may be fully detachable from the cooler body 11 for independent portable storage of articles.

Figure 7:
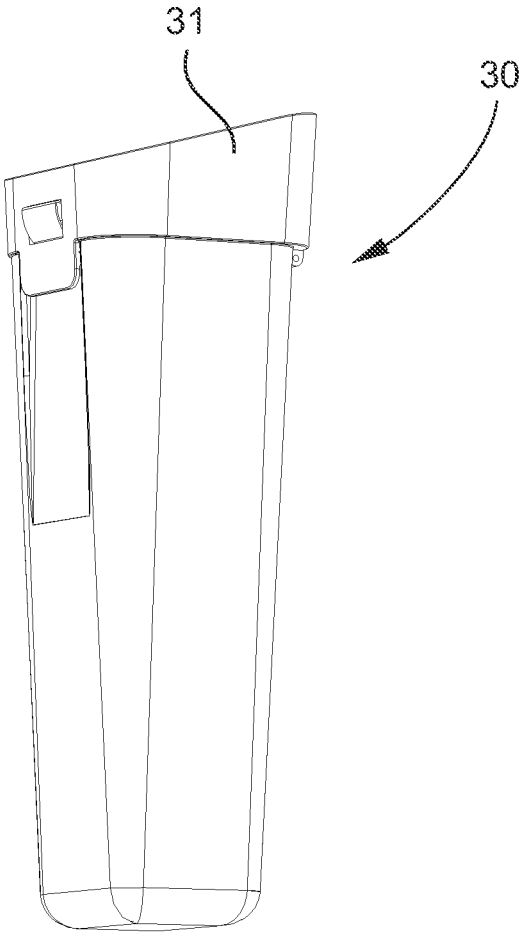
FIG. 7 is a perspective view of the removable storage canister utilized in the exemplary cooler assembly.
Figure 8:
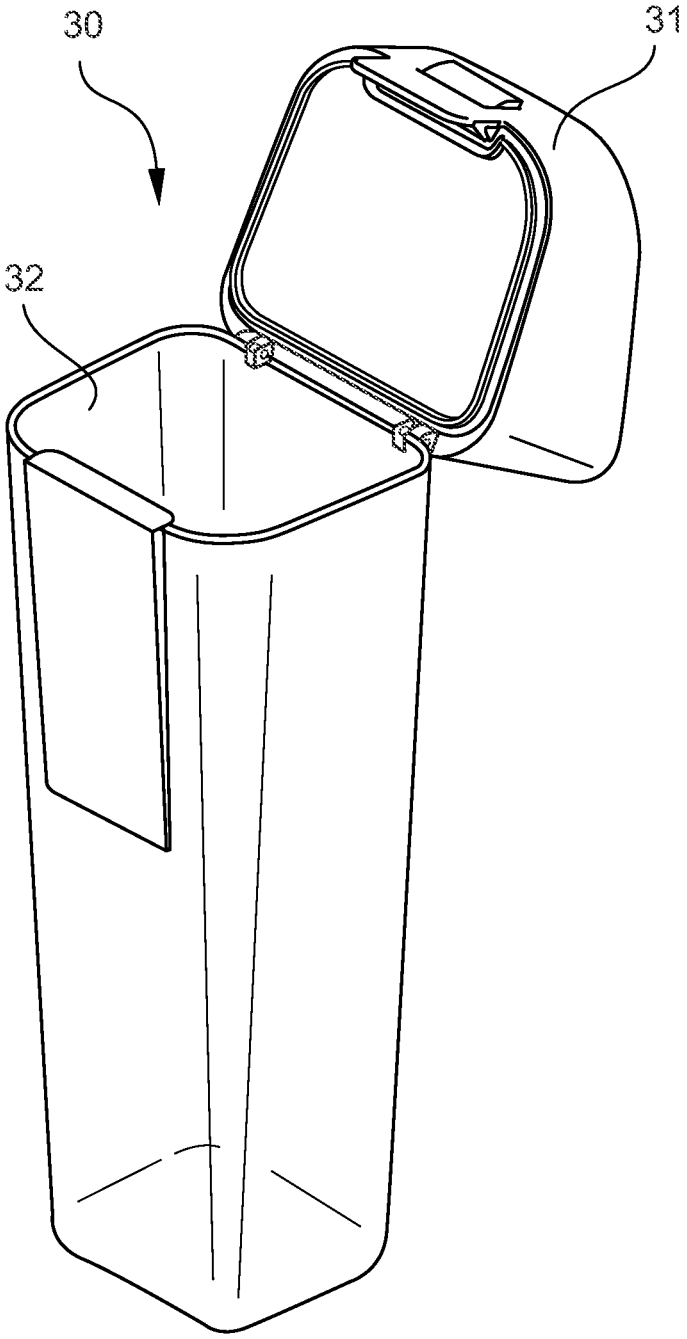
FIG. 8 is a further perspective view of the exemplary canister with its pivoted lid in an open position.
Figure 9:
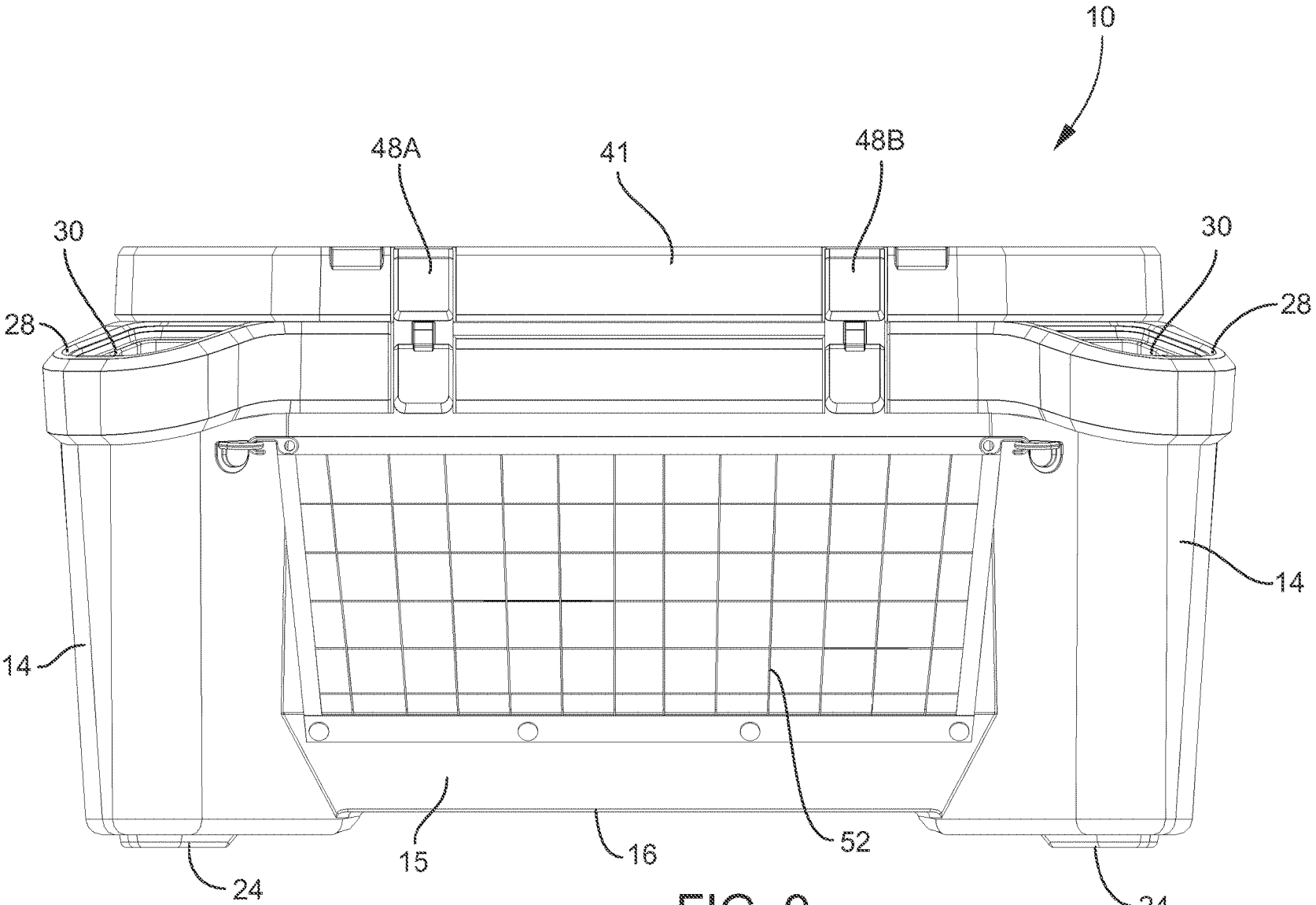
FIG. 9 is a front view of the exemplary cooler assembly.
Figure 10:
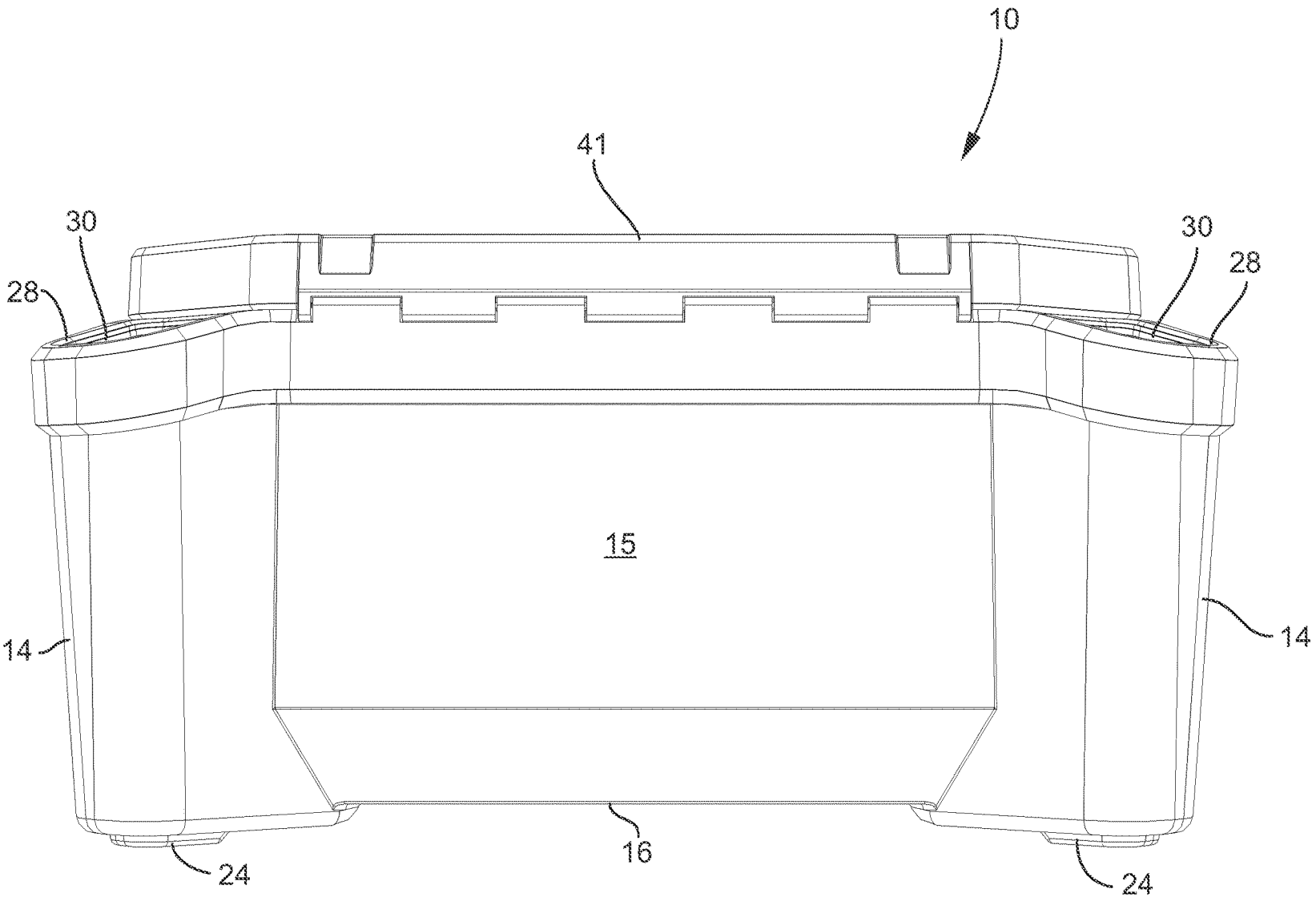
FIG. 10 is a rear view of the exemplary cooler assembly.
Figure 11:
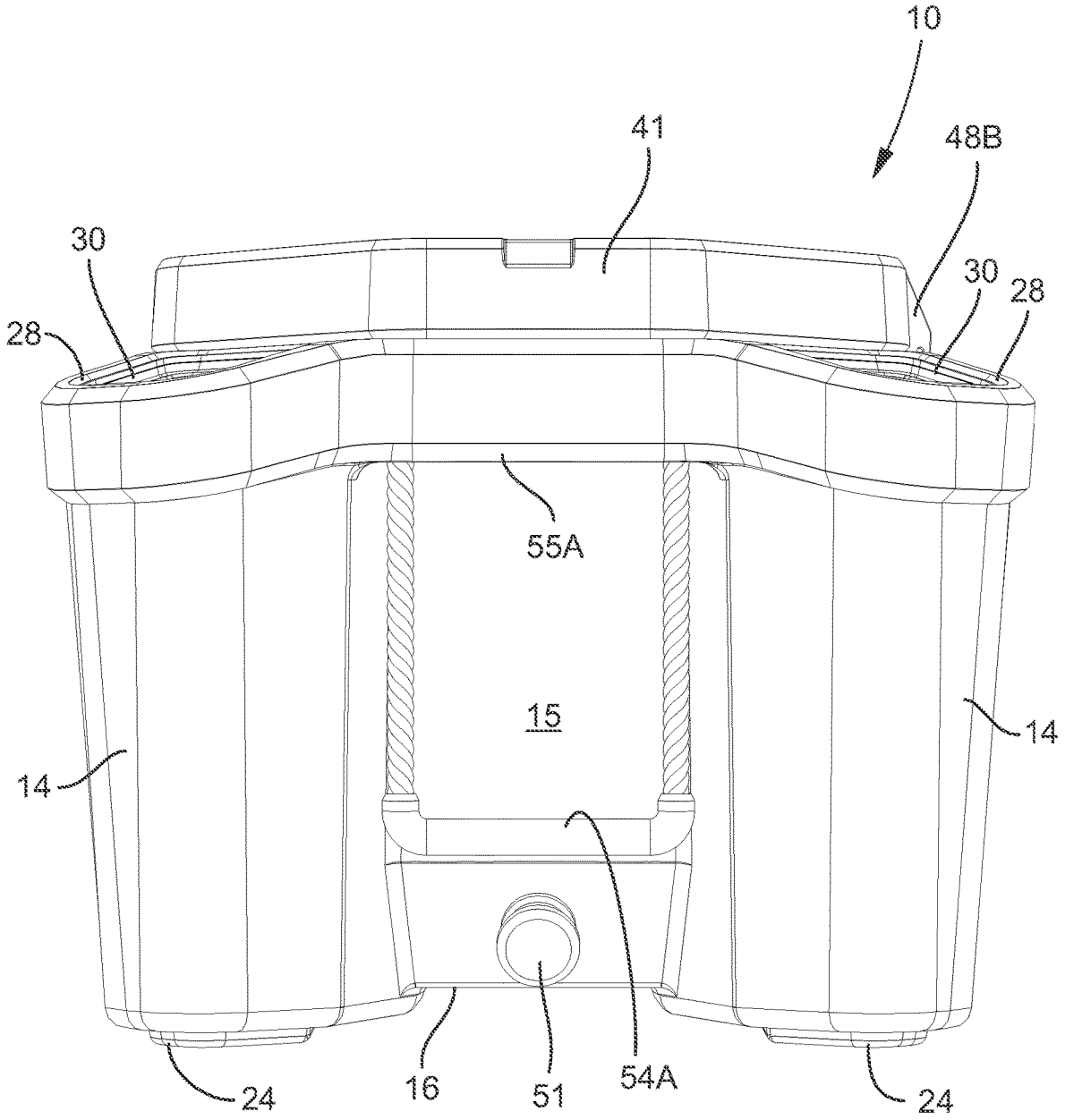
FIG. 11 is a first side view of the exemplary cooler assembly.
Figure 12:
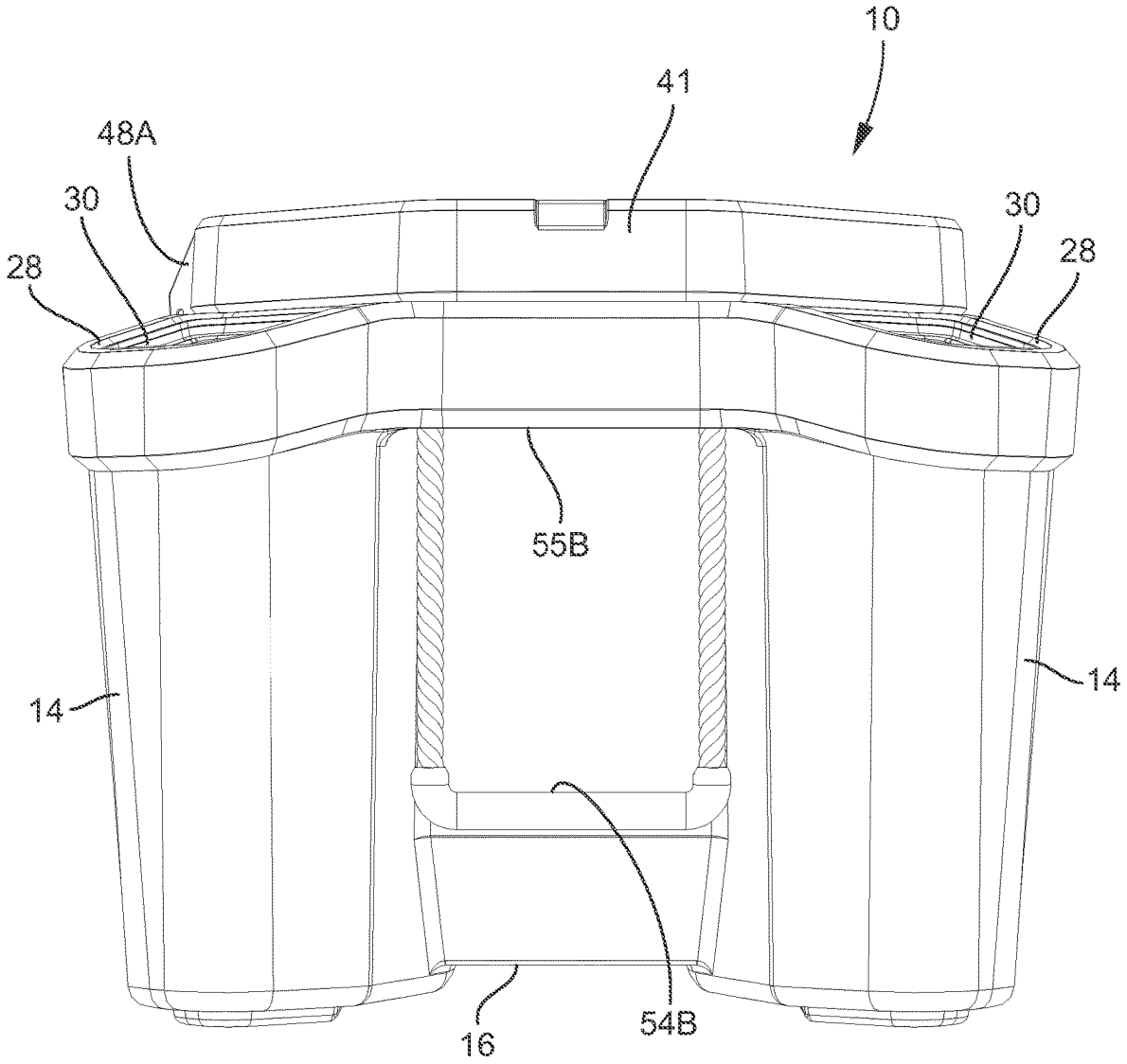
FIG. 12 is an opposite side view of the exemplary cooler assembly.

As best shown in FIGS. 7 and 8, the exemplary canister 30 is fabricated of any suitable material including plastic or metal, and may include a pivoted lid 31 adapted for selectively closing and sealing the open top 32. The lid 31 may have an integrated center lip handle 34 designed for gripping to conveniently insert and remove the canister 30 to and from the hollow interior of the turreted leg 14. The canisters 30 may store a variety of different articles, such as (e.g.) liquid beverages, hot and cold food items, fabric hammocks, hunting ammo, fishing tackle, hardware, rope, flares, fire extinguishers, straps, tools, bug spray, sunscreen, medicine, first aid supplies, and other such items. These and other articles may also be stored directly within the turreted legs 14—without the use of removable canisters 30 or other such containers. In one embodiment, the exemplary canister 30 comprises a 70 oz (approximately) kitchen-grade stainless steel, rust-resistant, double-wall and vacuum insulated sealable container designed to keep cold items cold and hot items hot. The exemplary container 30 may have an ergonomic hand grip and rubberized pad (not shown) on the bottom.

Referring again to FIGS. 3, 4, and 5, the exemplary cooler assembly 10 may further comprise a pivoted insulated cooler lid 41 adapted for selectively closing the open top 12 of the cooler body 11. When closed, as shown in FIG. 5, the cooler lid 41 is configured to cover only the open top 12 of the cooler body 11, such that the open top 28 of each turreted article-storage leg 14 remains uncovered (and unobstructed) and otherwise readily accessible. As best shown in FIG. 4, the lid 41 and cooler body 11 may comprise respective interlocking molded-in hinge elements 42, 44 designed to align and receive an elongated stainless steel pin 45. The hinge elements 42, 44 and pin 45 cooperate to enable pivoting movement of the lid 41 between open and closed positions. Cam latches 48A, 48B may be located opposite the pivot edge of the cooler lid 41 to releasably lock the lid 41 in the closed position over the cooler top 12. In exemplary embodiments, a freezer-quality silicone rubber gasket 49 encircles the open top 12 and creates form-fitting thermal barrier between the lid 41 and interior cooler compartment 18 of the cooler body 11. An optional cooler cushion (not shown) may be located on a top surface of the lid 41, thereby transforming the assembly 10 into a makeshift seat.

In addition to the above, the exemplary cooler assembly 10 may incorporate other common features and elements including a removable drain plug 51, an exterior cargo net 52 attached to a side wall of the cooler body 11, flexible bolt-through tote handles 54A, 54B attached to opposing side walls of the cooler body 11, and integrally-formed recessed lip handles 55A, 55B located adjacent the tote handles 54A, 54B. See FIGS. 9-12. The cooler assembly 10 may comprise UV inhibitors, non-corrosive durable hardware, and tie-down points (e.g., slots) on lid and handles, among other features not shown.

For the purposes of describing and defining the present invention it is noted that the use of relative terms, such as "substantially", "generally", "approximately", and the like, are utilized herein to represent an inherent degree of uncertainty that may be attributed to any quantitative comparison, value, measurement, or other representation. These terms are also utilized herein to represent the degree by which a quantitative representation may vary from a stated reference without resulting in a change in the basic function of the subject matter at issue.

Exemplary embodiments of the present invention are described above. No element, act, or instruction used in this description should be construed as important, necessary, critical, or essential to the invention unless explicitly described as such. Although only a few of the exemplary embodiments have been described in detail herein, those skilled in the art will readily appreciate that many modifications are possible in these exemplary embodiments without materially departing from the novel teachings and advantages of this invention. Accordingly, all such modifications are intended to be included within the scope of this invention as defined in the appended claims.

In the claims, any means-plus-function clauses are intended to cover the structures described herein as performing the recited function and not only structural equivalents, but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures. Unless the exact language "means for" (performing a particular function or step) is recited in the claims, a construction under 35 U.S.C. § 112(f) [or 6th paragraph/pre-AIA] is not intended. Additionally, it is not intended that the scope of patent protection afforded the present invention be defined by reading into any claim a limitation found herein that does not explicitly appear in the claim itself.

What is claimed:

1. A cooler assembly, comprising:

a cooler body having integrally formed insulated side walls, an insulated bottom and an open top, the side walls and bottom cooperating to define an insulated interior compartment of said cooler assembly; and a plurality of exterior turreted article-storage legs located adjacent the side walls of said cooler body and outside of said interior compartment, and in a top plan view of said cooler assembly each turreted article-storage leg extends outwardly at obtuse angles to adjacent side walls of said cooler body, and each turreted article-storage leg comprises a downwardly tapered hollow interior and an open downwardly tilted top forming a downwardly tilted opening for receiving an article to be stored within said hollow interior;

a pivoted cooler lid configured to selectively cover the open top of said cooler body, wherein the open top of each turreted article-storage leg remains uncovered and accessible when the cooler lid is in a closed position; and a portable canister configured to removably fit within the hollow interior of a selected one of said plurality of turreted article-storage legs.

2. The cooler assembly according to claim 1, wherein the open tops of respective turreted article-storage legs angle downwardly from the open top of said cooler body.

3. The cooler assembly according to claim 1, wherein said plurality of turreted article-storage legs are integrally formed with said cooler body, such that said article-storage legs and said cooler body comprise a single homogenous unit.

4. The cooler assembly according to claim 1, wherein said canister comprises a pivoted canister lid.

5. The cooler assembly according to claim 4, wherein said canister lid comprises a handle.

6. The cooler assembly according to claim 1, and comprising a dry storage basket removably positioned within the insulated interior compartment of said cooler assembly.

7. The cooler assembly according to claim 1, and comprising a compartment divider removably positioned within the insulated interior compartment of said cooler assembly.

8. The cooler assembly according to claim 1, wherein each of the side walls and bottom of said cooler body comprises a polyurethane foam insulation.

9. The cooler assembly according to claim 1, wherein said cooler body is constructed of a low-density polyethylene (LDPE) material.

10. The cooler assembly according to claim 1, and wherein said cooler body further comprises a removable drain plug.

11. The cooler assembly according to claim 1, and comprising a cargo net attached to an exterior of one of the side walls of said cooler body.

12. The cooler assembly according to claim 1, and comprising first and second flexible tote handles attached to opposing side walls of said cooler body.

13. The cooler assembly according to claim 1, and comprising first and second integrally-formed lip handles located on respective opposing side walls of said cooler body.

14. The cooler assembly according to claim 1, and comprising a plurality of rubber feet located beneath respective turreted article-storage legs.

* * * * *